US005582543A

United States Patent [19]

Maruyama

[11] Patent Number: 5,582,543

[45] Date of Patent: Dec. 10, 1996

[54] ABRADING DEVICE

[76] Inventor: Sho Maruyama, 4001 N. 9th St. PH7, Arlington, Va. 22203

[21] Appl. No.: 474,669

[22] Filed: Jun. 7, 1995

[51] Int. Cl.[6] ..... B24D 15/00

[52] U.S. Cl. ..... 451/523; 451/524; 451/540

[58] Field of Search ..... 451/523, 524, 451/552, 540, 539, 538

[56] References Cited

U.S. PATENT DOCUMENTS

| | | | |
|---|---|---|---|
| 651,479 | 6/1900 | Essich | 451/540 |
| 838,465 | 12/1906 | Seaborn | 451/524 |
| 2,408,815 | 10/1946 | Seward | 451/523 |
| 2,457,466 | 12/1948 | Hanna | 451/524 |
| 2,595,429 | 8/1950 | Trussell | 451/523 |
| 2,982,059 | 12/1958 | Trussell | 451/523 |
| 3,014,316 | 3/1960 | Barnhart | 451/523 |
| 4,688,356 | 8/1987 | Madzgalla | 451/523 |

*Primary Examiner*—Bruce M. Kisliuk
*Assistant Examiner*—Dona C. Edwards

[57] ABSTRACT

An abrading device comprising two planar members that are disposed in a spaced apart relationship by at least one spacing member, a plurality of abrasive particles distributed over only the outermost surfaces of said two planar members, the space between said planar members being large enough to accommodate and protect the extended fingers of a person using the device.

2 Claims, 1 Drawing Sheet

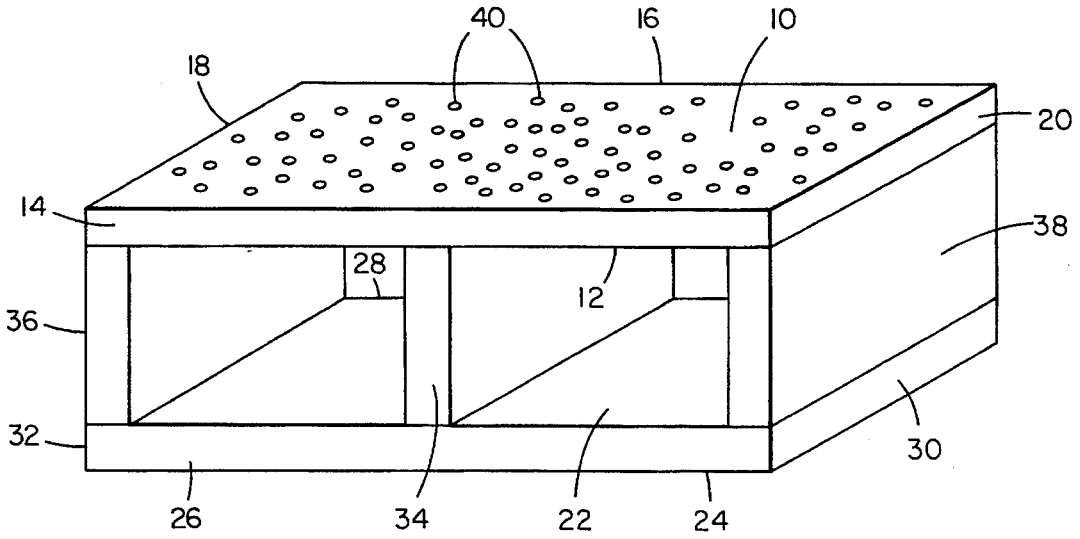
40
16
10
18
20
14
38
28
12
36
32
30
26
34
22
24

ABRADING DEVICE

This invention pertains to an abrading device which can be held in one hand, is especially useful for sharpening knives, and minimizes the chance that the user's fingers or hand will be accidentally cut during the abrading process.

It is well known that emery stones and similar devices can be used to sharpen knives. However, a disadvantage of such devices is that unless the user is very careful, there is some danger that the user may inadvertently cut one or more fingers.

Considered from one aspect, my invention involves an abrading device comprising in combination (a) a first planar member having an outer side, an inner side, two lateral sides and two ends, (b) a second planar member having outer side, an inner side, two lateral sides and two ends, (c) said first planar member and said second planar member being fixed in a spaced-apart relationship by at least one rigid spacing member interconnecting the inner side of said first planar member with the inner side of said second planar member, and (d) abrasive material on said outer sides of said first and second planar members, the space between said first and second planar members being sufficiently large to accommodate and protect the fingers of a person using the abrading device.

The FIGURE is a perspective view showing an abrading device according to the present invention.

One embodiment of my invention is illustrated in the attached drawing. As indicated above, it comprises a first planar member, a second planar member and at least one rigid spacing member. The first planar member includes an outer side 10, an inner side 12, two lateral sides 14 and 16 and two ends 18 and 20. The second planar member includes an outer side 24, and inner side 22, two lateral sides 26 and 28 and two ends 30 and 32. The rigid spacing members 34, 36 and 38 interconnect the first and second planar members. The rigid spacing member 34, the middle member, is optional for comfort and ease of use, and is used to keep the fingers toward the middle of the device, away from pressing on the ends. It assists in the use of the device by keeping the hand in the middle of the device, making it easier to maintain a consistent angle during the sharpening process. It may be omitted and replaced with ridges, knobs, knurls, etc. to keep the fingers in the middle of the device.

The first and second planar members are shown as rectangular in shape, but other shapes could be equally suitable. Three spacing members are shown, but a greater or lesser number could be used so long as the spacing between said first and second planar members is sufficient to comfortably accommodate two or more fingers of the user (and preferably all four fingers of the user). The end spacing members are required to shield the fingers from the sharp edge of the knife blade or tool.

The abrading device in the drawing is shown as consisting of five separate pieces joined together by bonding or welding. However, it will be appreciated that essentially the same structure could be made by extrusion, casting or some similar procedure. A preferred material for the device is a hard, rigid plastic, but it could also be made of wood or metal.

It is preferred that the outer side of the first planar member and the outer side of the second planar member contain abrasive particle 40 or be treated so that they are abrasive. This may be accomplished in any suitable way, such as embedding abrasive particles (e.g. diamonds, tungsten carbide, emery, silicon carbide, aluminum carbide, Arkansas stone, ceramic abrasives, etc.), bonding abrasive particles or bonding a separate sheet or piece of abrasive material to the outer sides of said first and second planar members. In some cases it may be desirable to provide only one of the said outer sides with abrasive matter. Also, the properties of the abrasive matter on the outer surface of the first planar member can have properties that are different from the properties of the abrasive matter on the outer surface of the second planar member.

An especially preferred size for my device is one each of the planar members is between 4 and 6 inches long, between 1 and 2 inches wide, and the two planar members are spaced about 1 to 1.5 inches apart, which is sufficient space to insert fingers between the two planar members.

My abrasive device has the advantages that it (a) can be easily gripped by the user, (b) can be firmly held while a knife or other tool is being sharpened by the abrasive surface and (c) protects the user's fingers against the possibility of being accidentally cut by the knife or tool being sharpened.

I claim:

1. An abrading device comprising in combination (a) a first planar member having an outer side, an inner side, two lateral sides and two ends, (b) a second planar member having an outer side, an inner side, two lateral sides and two ends, (c) said first planar member and said second planar member being fixed in spaced apart, essentially parallel relationship by at least one spacing member rigidly interconnecting the inner side of said first planar member with the inner side of said second planar member, (d) said first planar member, said second planar member and said at least one spacing member all being made of a hard, rigid plastic, metal, or wood material, (e) a plurality of abrasive particles affixed to only the outer sides of said first and second planar members so as to thereby form only two spaced apart abrasive layers, one abrasive layer being confined to the outer side of said first planar member and the other abrasive layer being confined to the outer side of said second planar member, (f) the space between said first and second planar members being large enough to accommodate and protect the extended fingers of a person using the abrading device.

2. An abrading device according to claim 1 wherein there are two end spacing members connecting opposing ends of said first and second planar members and at least one spacing member located between said two end spacing members.

* * * * *